United States Patent [19]

Dobkin

[11] 4,447,784

[45] May 8, 1984

[54] TEMPERATURE COMPENSATED BANDGAP VOLTAGE REFERENCE CIRCUIT

[75] Inventor: Robert C. Dobkin, Hillsborough, Calif.

[73] Assignee: National Semiconductor Corporation, Santa Clara, Calif.

[21] Appl. No.: 888,721

[22] Filed: Mar. 21, 1978

[51] Int. Cl.[3] ..... G05F 1/613; G05F 3/20

[52] U.S. Cl. ..... 323/226; 323/313

[58] Field of Search ..... 323/1, 4, 8, 9, 16, 323/19, 22 T, 223, 225, 226, 313-316; 307/296 R, 297

[56] References Cited

U.S. PATENT DOCUMENTS

| | | | |
|---|---|---|---|
| 3,851,241 | 11/1974 | Wheatley, Jr. | 323/19 |
| 4,017,788 | 4/1977 | Stepp et al. | 323/8 |
| 4,071,813 | 1/1978 | Dobkin | 323/8 |
| 4,088,941 | 5/1978 | Wheatley, Jr. | 323/8 |
| 4,103,219 | 7/1978 | Wheatley, Jr. | 323/8 |

OTHER PUBLICATIONS

Meijer et al., "An Integrated Bandgap Reference", IEEE Journal of Solid State Circuits, vol. SC-11, No. 3, pp. 403-406, Jun. 1976, I022-7603-3.

Lawton, "A 39.2 Mhz A.M.I.F. System", European Solid State Circuits Conference, Canterbury, Kent, England, 2-5, Sep. 1975, pp. 38, 39, S62460012F.

*Primary Examiner*—A. D. Pellinen

*Attorney, Agent, or Firm*—Gail W. Woodward; Paul J. Winters; Michael J. Pollock

[57] ABSTRACT

A pair of transistors, connected as a differential amplifier, is operated so that the transistors run at different current densities. A voltage divider is coupled across a pair of circuit terminals so that a portion of the terminal voltage is coupled to and used to differentially bias the transistors. An amplifier, responsive to the transistors differential output, and coupled to the divider, is used to vary the terminal voltage to force the differential output to zero. The transistor bias voltage thus generated has a positive temperature coefficient of voltage. A forward biased diode, which has a negative temperature coefficient of voltage, is also incorporated into the divider. When the terminal voltage is made equal to the semiconductor bandgap, the two temperature sensitive terms cancel to compensate the reference voltage.

2 Claims, 4 Drawing Figures

TEMPERATURE COMPENSATED BANDGAP VOLTAGE REFERENCE CIRCUIT

BACKGROUND OF THE INVENTION

The invention relates to an integrated circuit (IC) configuration that generates a reference voltage that is substantially constant regardless of temperature and supply current variations. The function is similar to that of the well-known zener diode. However, zener diodes have undesirably large temperature coefficients, are limited in voltages available in IC construction. They also generate undesirably large noise voltages, particularly in the vicinity of the voltage-current characteristic knee. In recent years, IC configurations have been developed that provide performance considerably superior to conventional IC zener diodes. Concurrently, superior zener diodes, such as the well known subsurface zeners, have been developed so that still better IC designs are needed.

The Prior Art

In the prior art one well known reference circuit is disclosed in U.S. Pat. No. 3,617,859 to Robert C. Dobkin and Robert J. Widlar. Here a two-terminal circuit develops a first voltage related to a multiple of the base-to-emitter voltage ($V_{BE}$) differential of a pair of transistors operating at different current densities and a second voltage related to the base-to-emitter voltage of a third transistor. The terminal voltage is made equal to the semiconductor bandgap of about 1.2 volts for silicon to produce a temperature compensated reference voltage. In this configuration, the transistor bases are coupled together and the $\Delta V_{BE}$ appears across a resistor in series with the emitter of the lower current density transistor.

Another circuit for generating a reference voltage is disclosed in the IEEE Journal of Solid-State Circuits, Vol SC-9 No. 6, Dec. 6, 1974, by A. Paul Brokaw (pages 388–393). The paper is titled "A Simple Three-Terminal IC Bandgap Reference." Here the transistor bases are connected together and a resistor coupled between the emitters develops the $\Delta V_{BE}$ produced by operating the transistor at different current densities. The transistor bases are driven by a feedback amplifier which responds the transistors differential output and drives the bases to a potential that produces zero differential. The base of the high current density transistor will then be at a potential that includes its $V_{BE}$ value and a multiple of the $\Delta V_{BE}$. Thus, temperature compensation occurs when the output voltage equals the semiconductor bandgap. In this circuit, the error introduced by transistor design imbalance is related to transistor alpha (the emitter-to-collector current gain) which is close to unity.

While the prior art circuits are quite useful, a better performing two-terminal device is still desired.

SUMMARY OF THE INVENTION

It is an object of the invention to provide an improved bandgap voltage reference which develops reduced errors and has more stable operation.

It is a further object of the invention to use IC fabrication with a minimum of critical parts to produce a stable two-terminal voltage reference.

It is a still further object of the invention to provide a bandgap reference that can operate at virtually any voltage over the bandgap voltage.

These and other objects are achieved in a circuit configured as follows. A pair of terminals has a voltage divider connected therebetween. A pair of differentially connected transistors is also coupled between the terminals. The transistors have their emitters connected together and returned through a current source to one terminal. The transistor collectors are returned through a load device to the other terminal. The transistor bases are coupled to two different points on the voltage divider. A high gain amplifier is coupled to respond to the transistor pair collector differential and acts to drive the voltage divider. Thus, the amplifier operates to drive the differential base voltage to produce zero collector differential voltage. If the transistors are operated at different current densities, the voltage divider current will be a function of $\Delta V_{BE}$ and will rise with temperature. If the voltage divider includes a forward biased diode and resistors to make up a terminal voltage of about 1.2 volts, the negative temperature coefficient of diode voltage will compensate the positive temperature coefficient of the differential voltage thereby yielding a compensated circuit.

If two diodes are incorporated into the voltage divider and the terminal voltage made equal to about 2.4 volts, compensation will also result. Still other multiples of 1.2 can be achieved.

In one embodiment, the voltage divider diode is the base emitter circuit of a transistor and the collector is returned to the appropriate terminal. An additional voltage divider is connected across the terminals and a tap thereon connected to the transistor base. The tap is chosen so that the transistor base voltage is at the desired bandgap voltage. Thus, the circuit is operative at any voltage over the bandgap.

DESCRIPTION OF THE INVENTION

Figure 1:
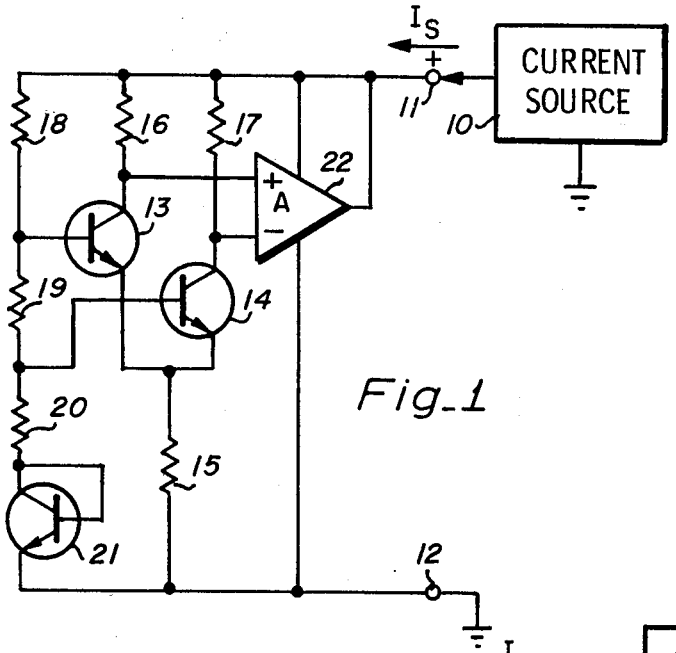
FIG. 1 is a simplified schematic diagram of a 1.2 volt reference.

In the schematic diagram of FIG. 1, a source of current 10 passes Is between circuit terminals 11 and 12. The ground return is shown only for convenience. The circuit can operate as a two terminal device at any potential level.

The heart of the device is a pair of transistors 13 and 14 connected differentially. Resistor 15 acts as a tail current source coupling the emitters to terminal 12. Resistors 16 and 17 act as collector loads connected to terminal 11. A voltage divider, consisting of resistors 18–20 and diode 21, is connected between terminals 11 and 12. The transistor bases are biased differentially by taps on the voltage divider as shown. An amplifier 22 senses the transistor differential collector voltage and has its output coupled to terminal 11.

In operation, transistor 13 runs at a higher current density than transistor 14. This can be achieved by making the two transistors of the same size and making resistor 17 larger than resistor 16 so that transistor 13 will carry more current. Alternatively, resistors 16 and 17 can be made to match so that the transistors will carry equal currents and the emitters of the transistors ratioed in the area. This latter alternative is preferred because in IC fabrication it is relatively easy to match resistors. Also, the transistors have a standardized emitter area and transistor 14 can be fabricated by connecting a plurality of standard emitters in parallel over a common collector.

Obviously, a third alternative is available in which both the resistors and emitter areas are ratioed. This alternative is useful when very large current density ratios are desired.

In operation, amplifier 22 will sense the differential voltage between transistor collectors and drive terminal 11 until the current flowing in the voltage divider produces a drop across resistor 19 that will force zero transistor collector potential difference.

If the transistor current densities are ratioed at 10:1, the potential forced across resistor 19 will be about 60 mv at 300° K. This differential base voltage $\Delta V_{BE}$ obeys the formula:

$$\Delta V_{BE}=(KT/q)\ \ln\ (J_{13}/J_{14}) \qquad (1)$$

Where:

K is Boltzmann's constant

T is absolute temperature q is the electron charge $J_{13}$ is the current density in transistor 13

$J_{14}$ is the current density in transistor 14.

If resistors 18 and 20 in combination are designed to have a value of nine times that of resistor 19, the divider resistors will produce a combined voltage drop of about 0.6 volt at 300° K. Since diode 21 will produce a similar drop at 300° K., the terminal voltage will be 1.2 volts which is very close to the bandgap of silicon. Thus as temperature rises and the voltage across diode 21 falls, $\Delta V_{BE}$ will rise so that the voltage across resistors 18–20 will rise in proportion to maintain the total voltage constant.

Figure 2:
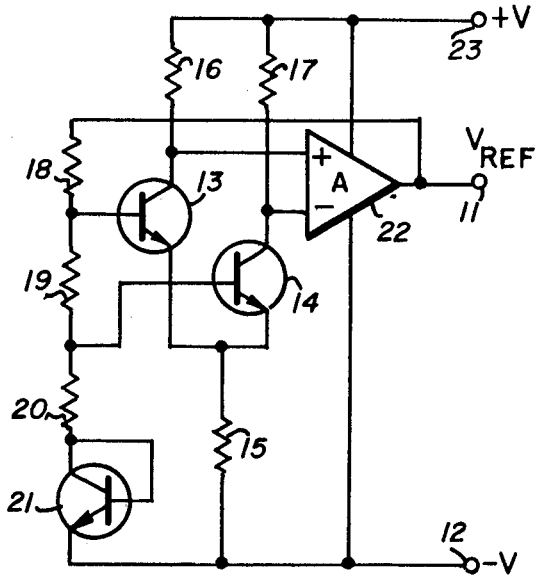
FIG. 2 is a simplified schematic diagram of a 1.2 volt reference operated in a three terminal configuration.

FIG. 2 shows a three terminal circuit version. Here a power supply is coupled between terminals 23 and 12. This would be the typical IC power supply. The 1.2 volt reference voltage, $V_{REF}$, is generated at terminal 11 with respect to terminal 12. The operation of the circuit is the same as that of FIG. 1.

Figure 3:
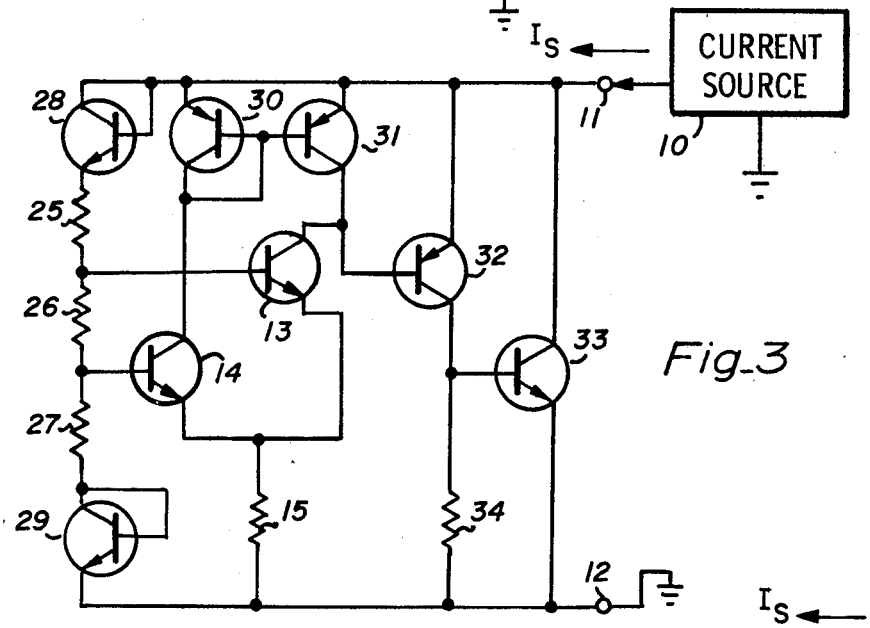
FIG. 3 is a detailed schematic diagram of a 2.4 volt reference.

FIG. 3 shows a more detailed, higher-voltage circuit. As before, current source 10 passes Is between terminals 11 and 12. The voltage divider, which contains resistors 25–27, also contains two series connected diodes 28 and 29.

Differentially operated transistors 13 and 14 and tail current resistor 15 are as was described for FIG. 1. However, the emitters of transistors 30 and 31 could be returned to a positive supply potential as shown at terminal 23 in FIG. 2. Transistors 30 and 31 comprise a conventional current mirror load for transistors 13 and 14 for converting the differential output to a single ended output that drives the base of amplifier transistor 32, the collector of which operates into load resistor 34. A second amplifier stage, transistor 33, has its collector and emitter electrodes coupled between terminals 11 and 12 and its base driven by transistor 32. Thus, a high gain amplifier has its input coupled to transistors 13 and 14 and its output drives the voltage divider to force the voltage across resistor 26 ($\Delta V_{BE}$) to produce a balanced collector output voltage. In this circuit, both resistors 25 and 27 are made about 10 times the value of resistor 26 so that about 1.2 volts will appear across the resistors at 300° K. A similar 1.2 volts will appear across diodes 28 and 29 in combination at 300° K. Compensation is achieved because the 2.4 volts is close to twice the silicon bandgap voltage. Clearly, other multiples involving a number of diodes equal to the multiple can be similarly implemented.

Figure 4:
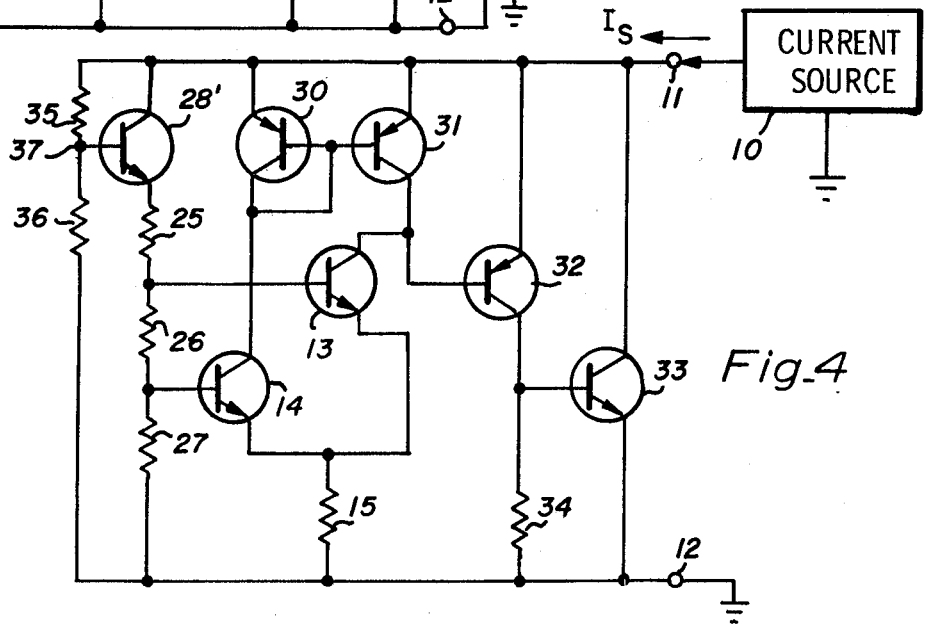
FIG. 4 is a detailed schematic diagram of a reference that can be operated in excess of 1.2 volts.

FIG. 4 shows a circuit using a technique that permits operating a bandgap reference at virtually any voltage over 1.2 volts. In this circuit, the diode connected transistor 28 of FIG. 3 is shown as transistor 28'. Resistors 35 and 36 have been added as a second voltage divider coupled between terminals 11 and 12 to bias the base of transistor 28'. Node 37 will now be the bandgap reference potential point and for the configuration shown will operate at about 1.2 volts. If the divider action provided by resistors 35 and 36 produces a two to one voltage division from terminal 11 to node 37, the potential difference between terminals 11 and 12 will be 2.5 volts. Thus, by simply selecting the values of resistors 35 and 36, any reference potential above 1.2 volts can be obtained.

EXAMPLE

The circuit of FIG. 3 was built substantially as shown using standard silicon IC processing. The NPN transistors were conventional and had Beta values of about 200. The area of transistor 14 was made ten times the area of transistor 13. The PNP transistors were of high gain lateral construction. The following resistor values were used:

| Resistor | Value |
|---|---|
| 15 | 15 kOhms |
| 25 | 6.6 kOhms |
| 26 | 600 Ohms |
| 27 | 6.6 kOhms |
| 34 | 30 kOhms |

The circuit operated at 2.5 volts over a terminal current range of about 300 microamperes to 10 milliamperes. The voltage remained constant to within 0.4% over a temperature range of 200° K. to 400° K.

The circuit shows excellent stability and can be manufactured to close tolerance using conventional IC processing. The major source of error resides in the difference between base currents of transistors 13 and 14. This error can be kept small.

The circuit of the invention has been described, equivalent versions shown, and an operating example given. Clearly, there are still other alternatives and equivalents that are within the spirit and intent of the invention and will occur to a person skilled in the art upon reading the above disclosure. Accordingly, it is intended that the scope of the invention be limited only by the claims that follow.

I claim:

1. A constant voltage reference circuit comprising:

first and second terminals for developing a constant potential therebetween in response to a current passed between said terminals;

first and second transistors, each having emitter, base and collector electrodes;

means for coupling said first and second transistor emitters together and, through a common current source, to said second terminal;

means coupled to said first and second transistor collectors for developing a differential output potential therebetween;

means for operating said first transistor at a higher current density than said second transistor;

first voltage divider means coupled between said first and second terminals, said first voltage divider including first and second intermediate potential points coupled respectively to said base electrodes of said first and second transistors, with said second potential point being closer to the potential of said second terminal than said first potential point;

amplifier means having an input responsive to said differential output of said first and second transistors and an output coupled to said first voltage divider means, said amplifier means being operative to force said differential to substantially zero by controlling the potential difference between said first and second intermediate potential points;

second voltage divider means coupled between said first and second terminals, said second voltage divider having at least one intermediate potential point operating at the bandgap potential of the transistor semiconductor material; and diode means coupled in series relationship with said first voltage divider means, said diode means being operative to develop a voltage having negative temperature coefficient to compensate the positive temperature coefficient of said potential difference between said first and second intermediate potential points, said diode means comprising the emitter-base circuit of a third transistor having an emitter coupled to said first voltage divider, a base coupled to said intermediate potential point on said second voltage divider and a collector coupled to said first terminal whereby the potential between said first and second terminals can be stabilized at any desired potential above said bandgap.

2. The circuit of claim 1 wherein said transistors are composed of silicon and said constant voltage is related to the bandgap potential of about 1.2 volts.

* * * * *

US004447784B1

REEXAMINATION CERTIFICATE (4169th)

United States Patent [19] [11] B1 4,447,784

Dobkin [45] Certificate Issued Oct. 17, 2000

[54] TEMPERATURE COMPENSATED BANDGAP VOLTAGE REFERENCE CIRCUIT

[75] Inventor: Robert C. Dobkin, Hillsborough, Calif.

[73] Assignee: National Semiconductor Corporation, Santa Clara, Calif.

Reexamination Request:
No. 90/005,610, Jan. 13, 2000

Reexamination Certificate for:

| | |
|---|---|
| Patent No.: | **4,447,784** |
| Issued: | **May 8, 1984** |
| Appl. No.: | **05/888,721** |
| Filed: | **Mar. 21, 1978** |

[51] Int. Cl.[7] ..... G05F 1/613; G05F 3/20
[52] U.S. Cl. ..... 323/226; 323/313
[58] Field of Search ..... 323/226, 313

[56] References Cited

U.S. PATENT DOCUMENTS 3,887,863 6/1975 Brokaw .
4,088,941 5/1978 Wheatley, Jr. .

OTHER PUBLICATIONS

Brokaw, 1974, "A Simple Three–Terminal IC Bandgap Reference," *IEEE Journal of Solid–State Circuits*, vol. SC–9 No. 6: 388–393 "No month".

*Primary Examiner*—Adolf Berhane

[57] ABSTRACT

A pair of transistors, connected as a differential amplifier, is operated so that the transistors run at different current densities. A voltage divider is coupled across a pair of circuit terminals so that a portion of the terminal voltage is coupled to and used to differentially bias the transistors. An amplifier, responsive to the transistors differential output, and coupled to the divider, is used to vary the terminal voltage to force the differential output to zero. The transistor bias voltage thus generated has a positive temperature coefficient of voltage. A forward biased diode, which has a negative temperature coefficient of voltage, is also incorporated into the divider. When the terminal voltage is made equal to the semiconductor bandgap, the two temperature sensitive terms cancel to compensate the reference voltage.

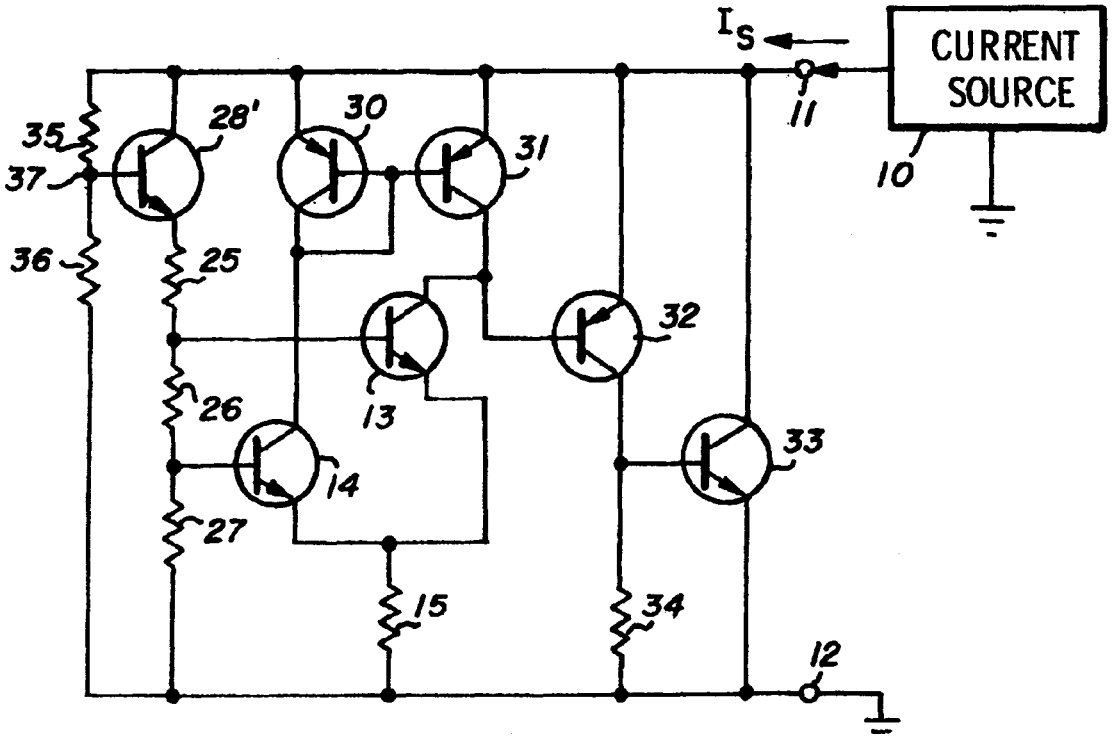

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *